US007263863B2

(12) United States Patent
Brinkmann et al.

(10) Patent No.: US 7,263,863 B2
(45) Date of Patent: Sep. 4, 2007

(54) FRONT-LOADING WASHING MACHINE

(75) Inventors: Martin Brinkmann, Rietberg (DE); Egon Brockschmidt, Guetersloh (DE); Matthias Knoke, Rheda-Wiedenbrueck (DE); Andreas Kratzsch, Bielefeld (DE); Ralf Kretschmer, Rheda-Wiedenbrueck (DE); Wilhelm Sebeikat, Verl (DE)

(73) Assignee: Miele & Cie. KG., Guetersloh (DE)

( * ) Notice: Subject to any disclaimer, the term of this patent is extended or adjusted under 35 U.S.C. 154(b) by 429 days.

(21) Appl. No.: 11/013,120

(22) Filed: Dec. 15, 2004

(65) Prior Publication Data

US 2005/0126231 A1 Jun. 16, 2005

(30) Foreign Application Priority Data

Dec. 15, 2003 (DE) ..... 103 59 011

(51) Int. Cl.
*D06F 39/00* (2006.01)

(52) U.S. Cl. ..... 68/24; 68/140; 68/196

(58) Field of Classification Search ..... 68/24, 68/58, 140, 196

See application file for complete search history.

(56) References Cited

U.S. PATENT DOCUMENTS

| | | | | |
|---|---|---|---|---|
| 2,996,809 A * | 8/1961 | Shapter | 34/75 |
| 3,080,252 A * | 3/1963 | Freier et al. | 427/2.3 |
| 3,841,117 A * | 10/1974 | Crivilles | 68/20 |
| 5,419,164 A * | 5/1995 | Durazzani | 68/23.2 |
| 5,860,300 A * | 1/1999 | Valent | 68/24 |
| 6,205,603 B1 * | 3/2001 | Vande Haar | 8/159 |
| 6,539,753 B1 * | 4/2003 | Ito et al. | 68/3 R |

FOREIGN PATENT DOCUMENTS

| | | |
|---|---|---|
| DE | 90 14 420.7 | 3/1991 |
| DE | 295 18 631 U1 | 3/1996 |
| DE | 102 37 017 B3 | 1/2004 |
| EP | 1 321 559 A1 | 6/2003 |
| EP | 1 389 642 A1 | 2/2004 |

* cited by examiner

*Primary Examiner*—Frankie L. Stinson
(74) *Attorney, Agent, or Firm*—Darby & Darby

(57) ABSTRACT

A front loading washing machine with a housing, a sudsing container and a drum having openings in substantially coaxial alignment, the sudsing container and the housing being connected by a folding bellows surrounding marginal portions of their respective openings and provided with a crease. An extension protruding into a gap between the crease and the rim of the opening of the drum, with the rim, the upper end of the extension and a portion of the crease being in at least partial coaxial alignment.

19 Claims, 4 Drawing Sheets

FRONT-LOADING WASHING MACHINE

BACKGROUND OF THE INVENTION

1. Field of the Invention

Figure 1:
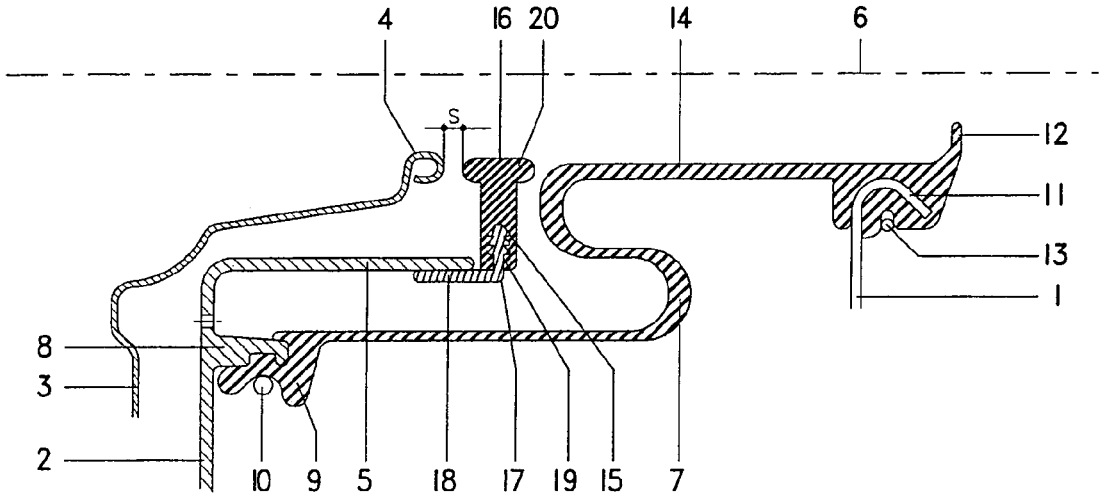

The invention, in general, relates to a front-loading washing machine and, more particular, to a front-loading washing machine of the kind provided with a housing with a substantially cylindrical sudsing container resiliently suspended therein and a cylindrical drum rotatably arranged within the sudsing container, the front walls or caps of the drum and of the sudsing container as well as the front of the housing being provided with substantially circular and coaxially disposed loading openings, and with an elastomeric folding bellows which sealingly connects the circumferential rim of the openings in the front of the housing and in the sudsing container and which is provided with a crease facing the common axis, and with an at least partially elastomeric extension protruding into the intermediate space between the crease and the rim of the loading opening of the drum, the rim, the upper end of the extension and a part of the crease being at least partially aligned in the axial direction. The invention also relates to a method of manufacturing such a washing machine.

2. The Prior Art

A washing machine of the kind referred to is known from DE 90 15 420 U1. In washing machines of this type, the crease is provided for absorbing oscillations caused by imbalances during spinning and leading to a relative movement or displacement between the sudsing container and the housing. In order to prevent wear of the folding bellows in the area of its crease as a result of friction at the rotating rim of the loading opening of the drum (drum rim), a sufficiently large spacing between the crease and the drum rim is required. This may lead to laundry extending over the rim of the drum slipping deeply into the gap and tearing as a result of the increased friction between the rotating drum and the stationary sudsing container. The extension shown in FIG. 2 of DE 90 15 420 U1 serves as a laundry deflector by reducing the gap between the rim of the drum and the gap, thereby preventing laundry from being pulled into the gap. The friction of the extension at the drum is not critical since its wear does not adversely affect the sealing of the folding bellows.

German Patent DE 102 37 017 B3 discloses a washing machine which in the area of the upper apex of the loading opening of the drum is provided with a laundry deflector. The laundry deflector extends into the space between the crease of the elastomeric folding bellows and the rim of the loading opening of the drum. By an L-shaped bend in the direction of the interior chamber of the drum, any pulled-in laundry is securely guided out of the crease or gap, as the case may be, and falls back into the drum. To this end, a deformation is required in the circumferential rim of the folding bellows in the area of the laundry deflector so that the laundry deflector may extend outwardly between the folding bellows and the rim of the loading opening of the drum. Hence, this area of the folding bellows is subject to premature wear.

It has, however, been found that the function of the deflector principle requires the gap to be adjusted with great precision which, in turn, requires a structurally stable hammer. Narrowing or contractions of the gap lead to wedging or squeezing in of laundry tips and, therefore, to excessive wear of the laundry. These conditions may be satisfied with relative ease in household laundry machines provided with loading openings of a diameter up to about 30 cm. Larger openings not only result in a reduced structural stability of the extension, but during assembly the adjustment of the gap becomes more difficult and complex as the diameter of the folding bellows increases.

OBJECTS OF THE INVENTION

It is, therefore, an object of the invention to provide a front-loading washing machine of the kind referred to supra in which maintenance of the desired gap dimension between the extension and the rim of the drum during assembly is simplified.

Moreover, it is an object of the invention to provide a method of manufacturing a washing machine of the kind referred to supra, in which it is simple to maintain the desired gap between the extension and the rim of the drum.

SUMMARY OF THE INVENTION

In accordance with the invention, the object is accomplished by a front-loading washing machine the front wall of the sudsing container of which is provided with at least one bracket extending in the direction of the common axis and by the extension being provided with a fastening element mounted on the bracket for axial movement relative thereto.

The method in accordance with the invention is accomplished by aligning the extension at a predetermined distance from the rim of the loading opening of the drum after the retaining element has been placed on the bracket.

Other and advantageous features of the washing machine in accordance with the invention will in part be obvious and will in part become apparent as the description unfolds.

The structure in accordance with the invention of the sudsing container front wall in the area of the rim of its loading opening and the mounting of a moveable retaining element at the extension make possible, during assembly, a very simple yet exact alignment relative to the rim of the drum. In an advance assembly operation, the retaining element may be connected to the resilient or elastic portion of the extension.

Advantageously, the bracket is of annular configuration.

In a further advantageous embodiment, the retaining element is structured as a slotted receiving element.

In an advantageous embodiment, the retaining element is structured as a support ring which in its mounted state at least partially engages the bracket or brackets, as the case may be. In this manner, it is easy to move the retaining element relative to the bracket.

In a further advantageous embodiment, the bracket and the retaining element are provided with matching threads. In this manner, following its adjustment the dimension of the gap remains constant over the entire circumference of the extension or rim of the drum because jamming between retaining element and bracket is prevented.

It is also advantageous angularly to bend the retaining element so that an arm disposed normal to the bracket will support the extension which is of T-shaped cross-section. In this manner, the extension may be fabricated in a simple manner, particularly if the extension consists of an angular plastic core and an elastomeric coating.

It is possible integrally to mold the elastomeric portion of the extension on the folding bellows. Alternatively, the extension may be structured as a separate component which makes it possible to structure its elastomeric portion harder than the folding bellows. The greater hardness results in reduced wear and tear and in a greater structural stability. Moreover, the assembly is simplified. In connection with sudsing containers provided with a plastic front wall the mounting of the extension and of the folding bellows is simplified by a clamping rod for the folding bellows is molded in addition to the bracket.

In a further advantageous embodiment, the extension with a margin angled towards the sudsing container consists of a hard plastic or of a hard elastomeric component with which the folding bellows of soft elastomeric material is integrally formed. The margin angled in the direction of the sudsing container and which circumscribes the bracket of the sudsing container is attached by a circumferential clamping ring.

To prevent the extension from axially slipping on the bracket of the sudsing container, the angled bracket and the retaining element of the sudsing container may in their engagement section be of toothed, undulating or saw-tooth or similar interlocking configuration.

DESCRIPTION OF THE SEVERAL DRAWINGS

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

FIGS. 1, 2, 3 and 4 are schematic views of partial sections of washing machines in accordance with the invention in the lower portion of the loading openings; and FIGS. 1*a*, 1*b*, 1*c* and FIGS. 2*a*, 2*b*, 2*c* depict the extension and parts thereof in detailed views.

DESCRIPTION OF THE PREFERRED EMBODIMENTS

As is well known, a washing machine is provided with a housing within which a substantially cylindrical sudsing container is resiliently suspended. Within the sudsing container, a drum is journaled for rotations, the axis of rotation of the drum and the axis of symmetry of the sudsing container coinciding as substantially common axis 6. In the examples shown, the common axis 6 extends horizontally. It may, however, also be slightly inclined (not shown) towards the rear of the housing. The front walls 2 and 3, hereinafter sometimes referred to as caps, of the drum and of the sudsing container are provided with circular loading openings. The rim of the front wall 3 of the drum is bent about 45° relative to the exterior of the drum and is curled in its outer marginal section. This section will hereafter be referred to as drum rim 4. The front cap 2 of the sudsing container may be made of plastic (fiber-glass reinforced polypropylene) are ferrous sheet metal. In either case, the rim of the front cap 2 facing the opening is provided with an annular bracket 5 angled by 90°. In terms of its function to be described, it is important to note that the bracket in its marginal section depicted to the right of the drawings is not provided with any flange or the like; it is merely extending in the direction of the axis 6. In the case of a plastic sudsing container, the bracket 5 is connected by injection molding. In a sheet-metal sudsing container the bracket is formed by bending the margin. A loading opening is also provided in the front wall 1 of the housing which is sealed in a liquid-proof manner by a door not shown in the drawings. The margin of every one of the three loading openings includes a circular surface disposed vertically and symmetrically with respect to the axis 6.

Figure 2:
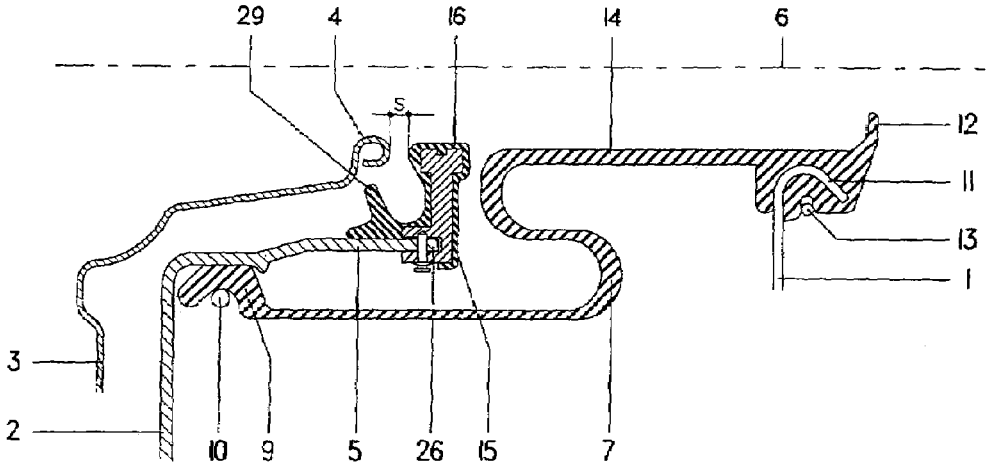
Figure 2A:
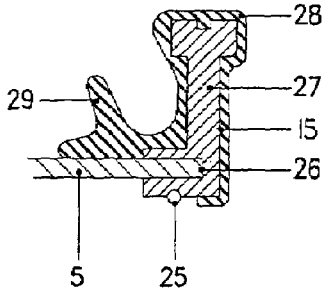
Figure 2B:
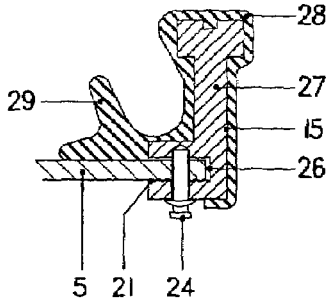
Figure 3:
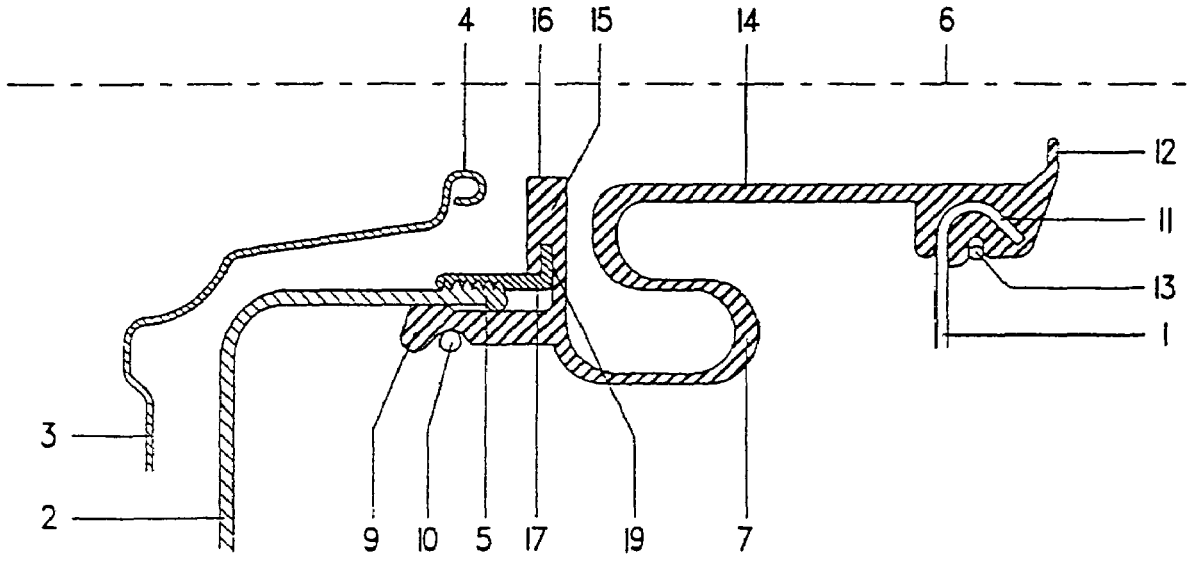

To prevent water from escaping from the sudsing container into the interior of the housing, the sudsing container cap 2 and the front wall 1 of the housing are connected in the marginal area of their loading openings by a folding bellows 7 made of EPDM of a Shore A hardness of 35 to 40. As seen in FIG. 1, a clamping ring 8 is formed on the plastic sudsing container cap 2 for accepting the rim 9 of the folding bellows 7 facing the sudsing container which is thereafter affixed to the ring by a clamping ring 10. FIGS. 2 and 3 depict embodiments in which the folding bellows 7 is affixed to the lower surface of a bracket 5. In the area of the rim 11 of the loading opening the front wall 1 of the housing is flanged so that the rim 12 of the folding bellows 7 facing the housing may also be attached by a clamping ring 13.

A laundry deflector structured as an extension 15 is inserted into the gap formed between the drum rim 4 and the crease 14 of the folding bellows 7 directed towards the axis 6. The upper end 15 of the deflector extends to the height of a connecting line between the drum rim 4 and the upper margin of the crease 14, so that these three components are at least in part axially aligned. At its other end, the extension 15 is provided with a retaining element at least a part of which is extending in the direction of the bracket 5. FIG. 1 depicts a variant in which the retaining element is structured as an angular support ring 17. Its horizontal arm 18 at least partially engages the bracket 5; its vertical arm 19 supports an elastomeric component 20 of T-shaped cross-section and made of EPDM. By means of a slide connection (FIG. 1*a*), a threaded connection 21 (FIG. 1*b*) or a toothed snap connection 22 (FIG. 1*c*), the support ring may thus be moved in the direction of the axis 6, and the distance s between the upper end '6 of the extension 15 and the drum rim 4 may thus be adjusted. Following alignment of the extension 15, the support ring 17 may be permanently affixed to the bracket 5 by a welded connection 23 (FIG. 1*a*, a safety screw 23 (FIG. 1*b*) or clamping ring 25 (FIG. 1*c*). Any combination of the alignment of the gap s and the permanent attachment is possible. In the case of a permanent attachment by a welding connection, the bracket 5 and the support ring 17 should consist of the same material.

Figure 2C:
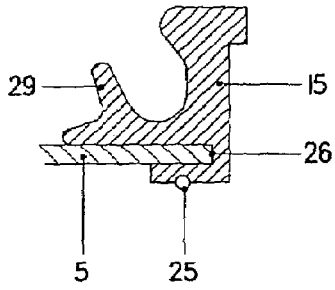

FIG. 2 and FIGS. 2*a*, 2*b* and 2*c* depict embodiments in which the retaining element is structured as a slotted receptacle 26 and is connected to the extension. In this case, too, the previously mentioned ways of adjusting the gap and permanent mounting on the bracket may be freely varied. In some examples (FIGS. 2, 2*a*, 2*b*), the extension 15 consists of a plastic core 27 with an elastomeric coating 28. FIG. 2*c* depicts a one-piece extension 15 made of an elastomeric material, e.g. EPDM. All variants are provided with an integral deflector lip 29 for preventing small articles (coins, nails, etc.) inadvertently left in the pockets of laundry from moving into the area between the drum and the sudsing container where they may damage the output section of the sudsing container.

Figure 1A:
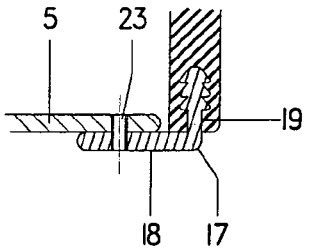
Figure 1B:
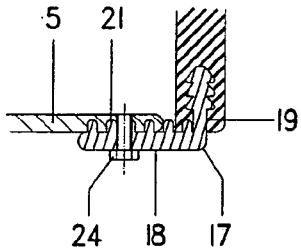
Figure 1C:
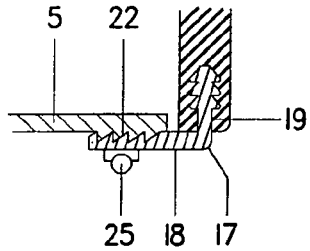

In the embodiments of FIGS. 1, 1*a*, 1*b* as well as in the embodiments of FIG. 2*c* it was shown to be useful, to use a material for the elastomeric component 20 or the coating 27 of the extension 15 which is of greater hardness than the folding bellows 7. This ensures greater structural stability and abrasion resistance and, in turn, a constant gap dimension s over the entire life of the washing machine. In these embodiments, a covering ring of chromium steel may be placed on the upper end 16 of the extension 15 (not shown).

In the variant shown in FIG. 3, the elastomeric component of the extension is molded onto the folding bellows. This component is provided with a receiving slot 30 in which an angled support ring 17 (see FIG. 1) is supported. It is thus possible after aligning the extension 15 to attach the extension 15 and the folding bellows with but one clamping ring 10. This requires accepting the disadvantage of the extension 15 also consisting of the material of lower hardness which must be used for manufacturing the folding bellows 7.

Figure 4:
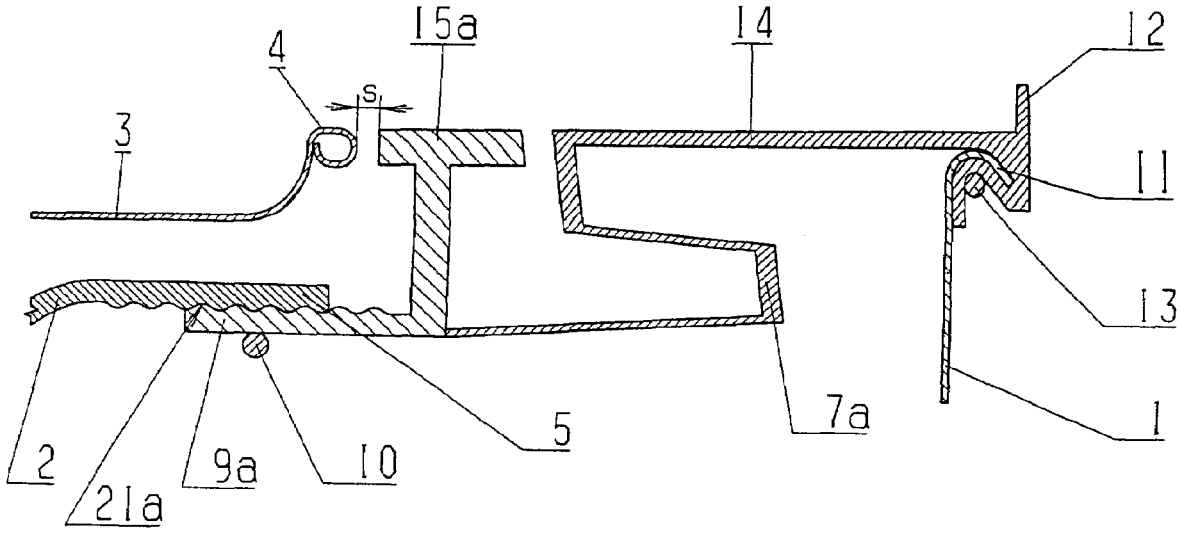
Figure 4A:
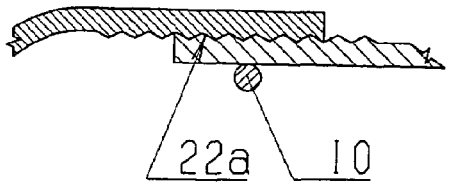
Figure 4B:
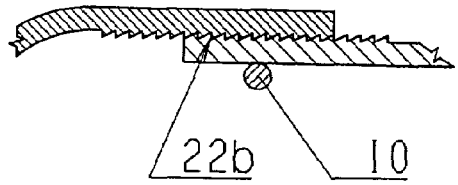

FIG. 4 depicts an embodiment in which the extension 15*a* is unitary with the folding bellows 7*a*, the extension 15*a* consisting of a hard material and the folding bellows 7*a* consisting of a soft material, e.g. of a soft elastomeric material. It may be fabricated, for instance, in a two-component injection molding process. Alternatively, the folding bellows 7*a* made of a soft material may be adhesively connected or welded to the extension 15*a*. At its lower surface the extension 15*a* is bent 9*a* at an angle in the direction of the sudsing container and is pushed over the bracket 5 of the sudsing container. The angled portion 9*a* is attached to the bracket 5 by a clamping ring 10. The extension 15*a* is thus affixed to the bracket 5. In order to prevent axial movement of the extension 15*a* or during assembly to arrest it in a preferred position, the angle portion 9*a* and the bracket 5 in the area of contact are provided with an interlocking undulation 21*a*, triangular teeth 22*a* (FIG. 4*a*) or a saw-tooth arrangement 22*b* (FIG. 4*b*).

What is claimed is:

1. A front-loading washing machine, comprising:

a housing provided with a front panel having a first opening therein with an axis extending therethrough in a substantially horizontal disposition;

a substantially cylindrical sudsing container resiliently suspended in the housing and comprising a front wall with a second opening substantially coaxially aligned with the first opening;

a cylindrical drum rotatably mounted in the sudsing container and provided with a third opening in substantially coaxial alignment with the first and second openings;

an elastomeric folding bellows sealingly connecting circumferential marginal portions of the first and second openings and provided with a crease directed towards the axis;

an extension protruding into a gap between the crease and the rim of the third opening, the rim of the third opening, an upper end of the extension and a portion of the crease being in at least partial axial alignment;

at least one bracket mounted on the sudsing container in a marginal portion of the second opening and extending in the direction of the axis; and a retaining element connected to the extension for axial movement relative to the at least one bracket.

2. The washing machine of claim 1, wherein the extension is at least in part of elastomeric material.

3. The washing machine of claim 1, wherein the bracket is of annular configuration.

4. The washing machine of claim 1, wherein the retaining element is structured as a slotted receiver.

5. The washing machine of claim 1, wherein the retaining element is structured as a support ring in at least partial engagement with the at least one bracket.

6. The washing machine of claim 5, wherein the extension is provided with a portion of T-shaped cross-section.

7. The washing machine of claim 6, wherein the support ring is of angular configuration and is provided with an arm disposed vertically relative to the bracket for supporting the portion of T-shaped cross-section.

8. The washing machine of claim 1, wherein the retaining element and the at least one bracket are provided with interlocking threads.

9. The washing machine of claim 1, wherein the extension comprises a angularly disposed plastic core and an elastomeric coating.

10. The washing machine of claim 9, wherein the elastomeric portion of the extension is connected to the folding bellows.

11. The washing machine of claim 9, wherein the elastomeric coating of the extension is of a greater hardness than the folding bellows.

12. The washing machine of claim 1, wherein the extension is a component separate from the folding bellows.

13. The washing machine of claim 1, wherein the extension comprises a rim angled with respect to the sudsing container and is made of one of a hard plastic and a hard elastomeric component with the folding bellows consisting of a soft elastomeric component being attached to the rim.

14. The washing machine of claim 13, wherein the rim is attached to the bracket by a clamping ring.

15. The washing machine of claim 13, wherein the rim of the extension and the bracket are of interlocking undulated form.

16. The washing machine of claim 13, wherein the rim and the bracket are provided with interlocking teeth.

17. The washing machine of claim 13, wherein the rim and the bracket are provided with interlocking saw-teeth.

18. The washing machine of claim 13, wherein the extension is placed on the bracket so as to provide a predetermined spacing to the rim of the third opening.

19. The washing machine of claim 18, further comprising means for arresting the retaining element on the bracket with the extension is the predetermined position.

* * * * *